US011553803B2

(12) United States Patent
Cailley et al.

(10) Patent No.: US 11,553,803 B2
(45) Date of Patent: Jan. 17, 2023

(54) FLEXIBLE MEMBER WITH ADJUSTABLE STIFFNESS FOR LYING AND/OR SITTING FURNITURE

(71) Applicant: TOURNADRE SA STANDARD GUM, Bourges (FR)

(72) Inventors: Géraud Cailley, Bourges (FR); Pascal Lobry, Bourges (FR); Jacques Lobry, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 439 days.

(21) Appl. No.: 16/716,674

(22) Filed: Dec. 17, 2019

(65) Prior Publication Data

US 2020/0196770 A1 Jun. 25, 2020

(30) Foreign Application Priority Data

Dec. 21, 2018 (FR) ..... 1874036

(51) Int. Cl.
*A47C 27/06* (2006.01)
*A47C 27/04* (2006.01)
*A47C 23/04* (2006.01)

(52) U.S. Cl.
CPC ..... *A47C 27/061* (2013.01); *A47C 27/065* (2013.01)

(58) Field of Classification Search
CPC ..... A47C 27/06; A47C 27/04; A47C 27/065; A47C 23/04; A47C 23/0438
See application file for complete search history.

(56) References Cited

U.S. PATENT DOCUMENTS 1,020,350 A * 3/1912 Hawkes ..... A47C 23/0438 5/256
2,842,784 A * 7/1958 Grund ..... A47C 27/061 5/936
3,608,107 A * 9/1971 Kentor et al. ..... A47C 27/061 267/89
4,667,357 A * 5/1987 Fortune ..... A47C 23/0435 5/936

(Continued)

FOREIGN PATENT DOCUMENTS

DE 102008050108 A1 4/2010
EP 1155643 A2 11/2001

(Continued)

*Primary Examiner* — David R Hare
*Assistant Examiner* — Ifeolu A Adeboyejo
(74) *Attorney, Agent, or Firm* — The Webb Law Firm

(57) ABSTRACT

The invention relates to a flexible member with adjustable stiffness for lying and/or sitting furniture. This member includes one or more inner spring(s) oriented along a central axis, one or more pair(s) of outer helical springs about the central axis, and a rotating part able to rotate, about the central axis, between a blocking position and an unblocking position. Each pair of outer helical springs includes an upper outer helical spring and a lower outer helical spring, connected by a corresponding hinge, which has a pivot axis orthogonal to the central axis. In the blocking position, the rails engage the corresponding hinges of the pairs of the outer helical spring, so as to prevent radial displacement, relative to the central axis, of the corresponding hinges, while the unblocking position allows the radial displacement of each corresponding hinge.

9 Claims, 5 Drawing Sheets

(56) References Cited

U.S. PATENT DOCUMENTS 5,332,202 A * 7/1994 Wagner ..... A47C 23/002 5/255
5,426,799 A * 6/1995 Ottiger ..... A47C 23/06 5/247
5,787,533 A * 8/1998 Fromme ..... A47C 23/002 5/255
5,896,604 A * 4/1999 McLean ..... A47C 19/027 297/284.8
6,113,082 A * 9/2000 Fujino ..... F16F 1/025 267/110
6,487,738 B1 * 12/2002 Graebe ..... A47C 23/043 5/719
6,704,960 B1 * 3/2004 Lumgair ..... A47C 27/14 5/719
6,826,791 B2 12/2004 Fromme
7,520,011 B1 * 4/2009 Liberkowski ..... A61G 7/05707 5/729
10,617,223 B2 * 4/2020 Bayer ..... A47C 23/002
2008/0128965 A1 * 6/2008 Bock ..... A47C 27/07 267/101
2008/0189868 A1 * 8/2008 Wieland ..... A47C 23/002 5/719
2009/0014929 A1 * 1/2009 Bock ..... A47C 23/002 267/179
2014/0137337 A1 * 5/2014 DeFranks ..... A47C 27/00 5/722
2017/0340129 A1 * 11/2017 Leng ..... A47C 19/005
2018/0325273 A1 * 11/2018 Cailley ..... A47C 23/002
2018/0325275 A1 * 11/2018 Cailley ..... F16F 1/041

FOREIGN PATENT DOCUMENTS

EP 1386564 A1 2/2004
EP 3400841 A1 11/2018
WO 9627312 A1 9/1996
WO 2008015235 A1 2/2008

* cited by examiner

[Fig. 1A]
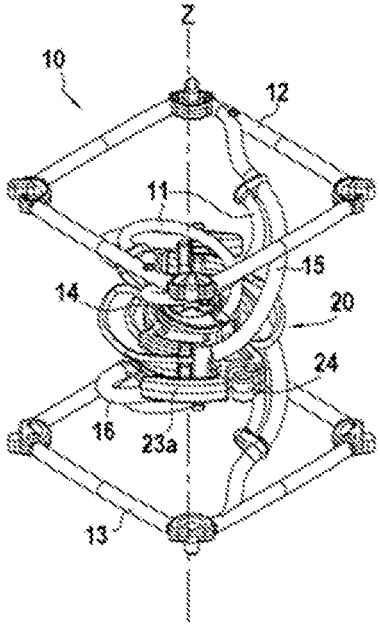
[Fig. 1B]
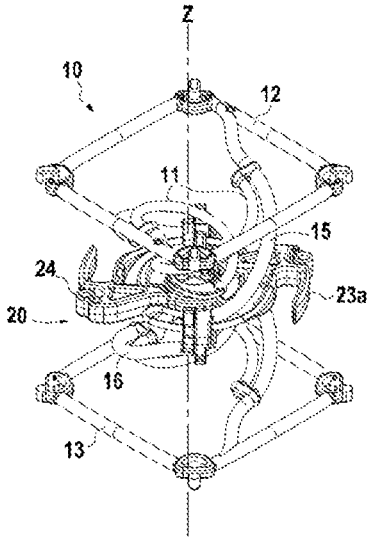

[Fig. 2A]
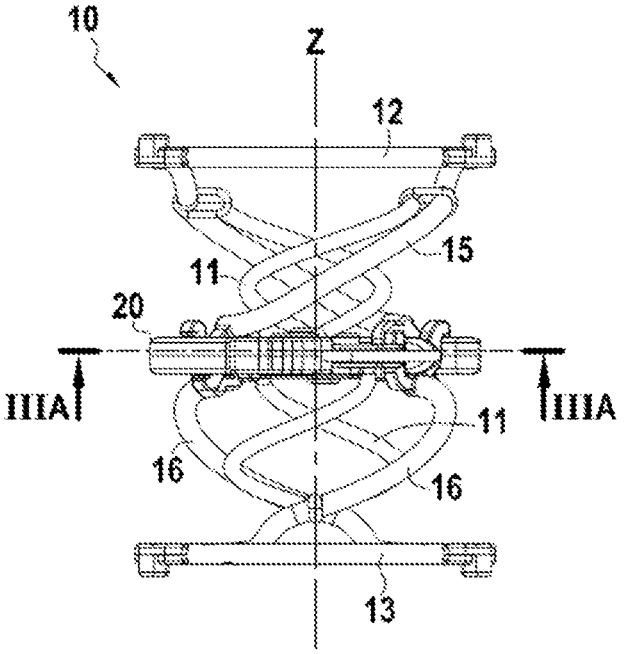
[Fig. 2B]
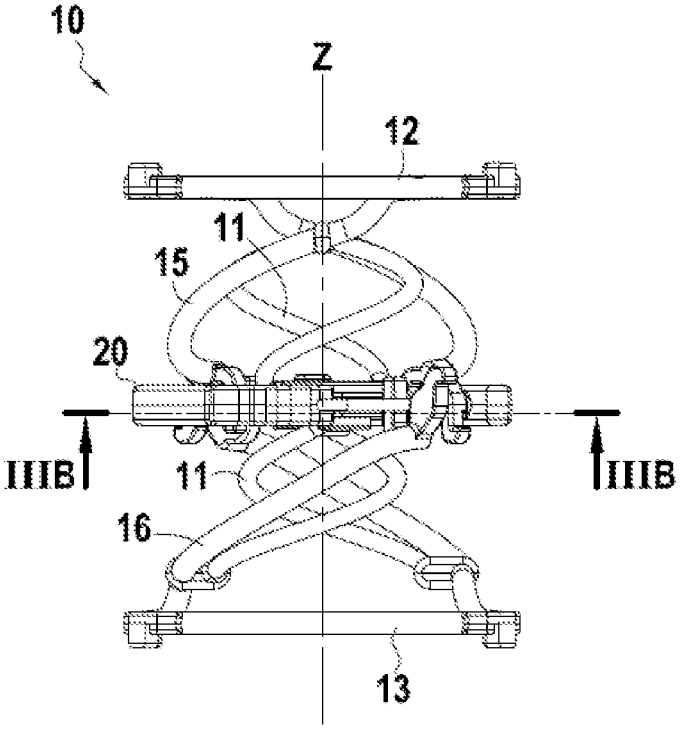

[Fig. 3A]
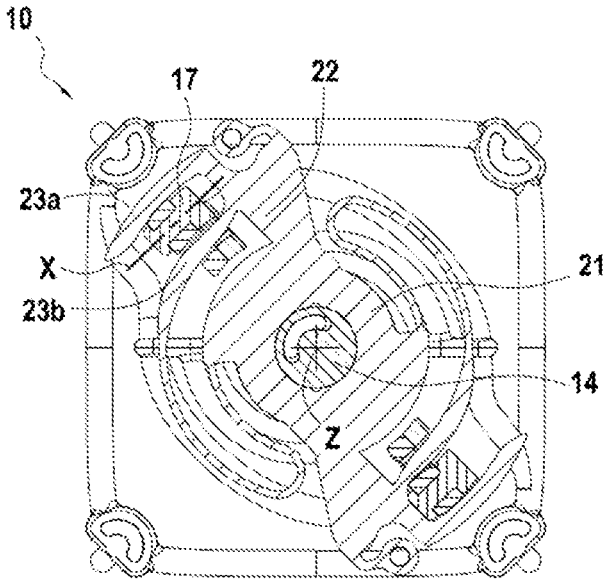
[Fig. 3B]
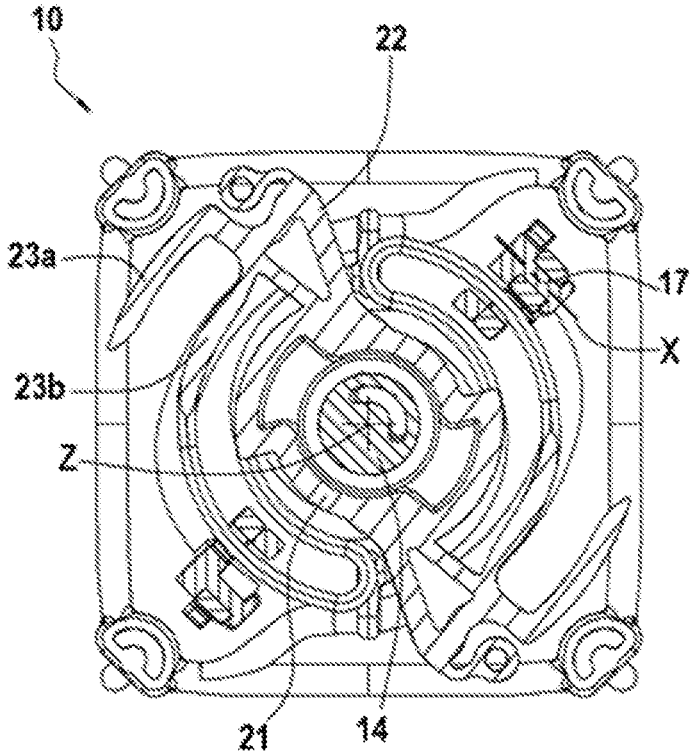

[Fig. 4]
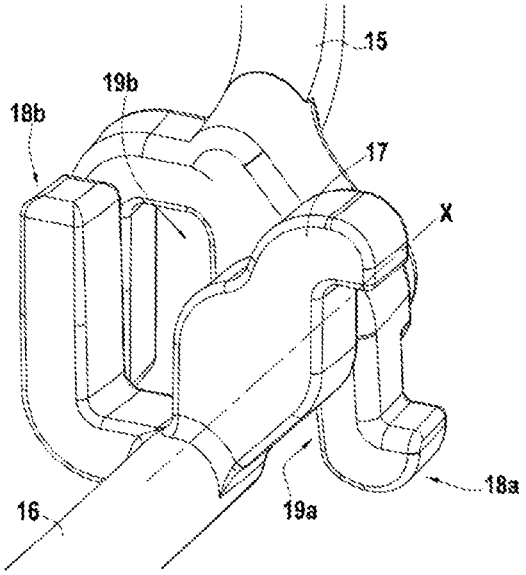
[Fig. 5]
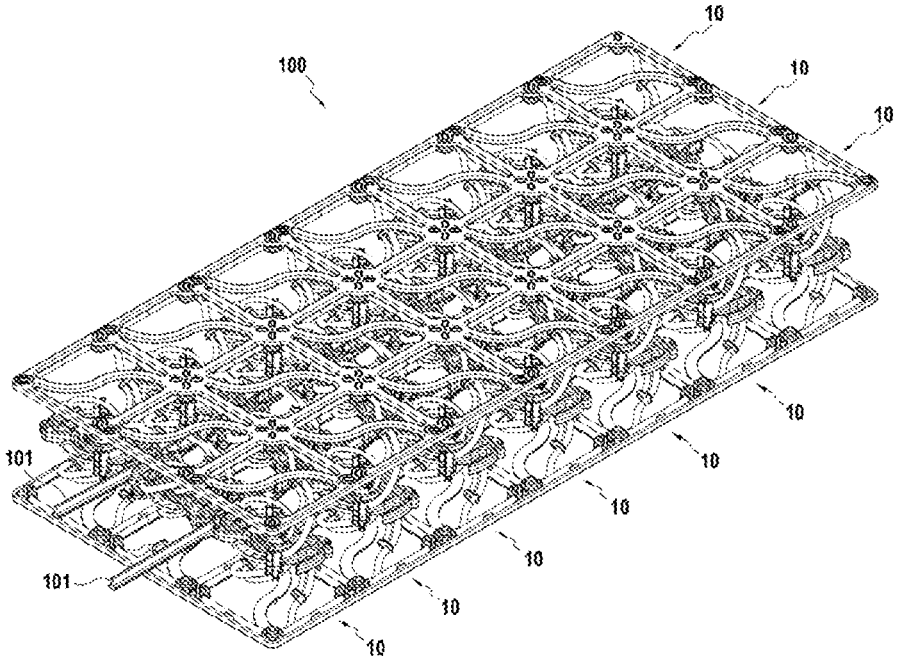

[Fig. 6]
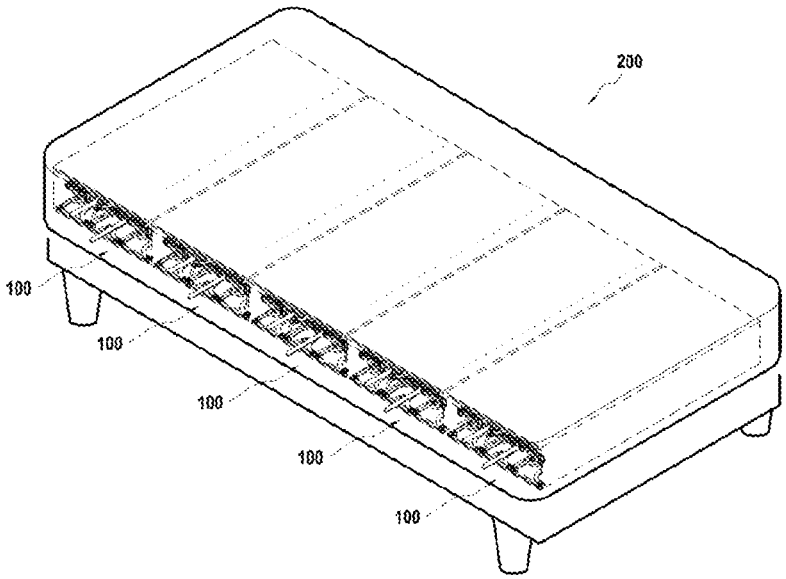
[Fig. 7]
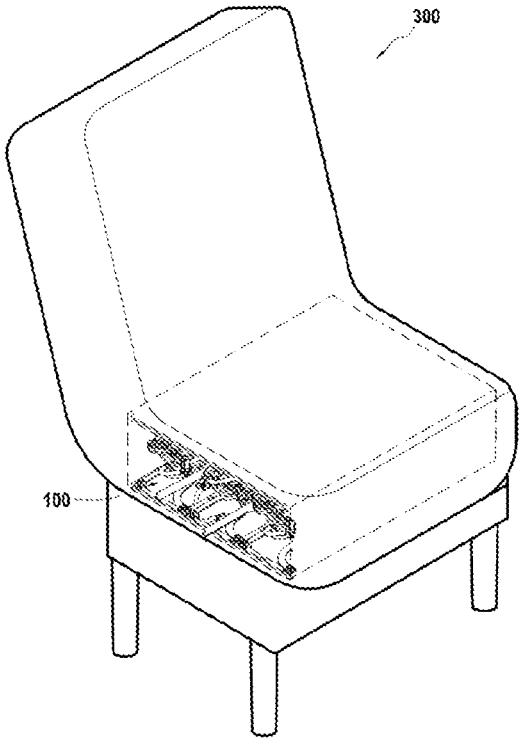

FLEXIBLE MEMBER WITH ADJUSTABLE STIFFNESS FOR LYING AND/OR SITTING FURNITURE

CROSS-REFERENCE TO RELATED APPLICATION

This application claims priority to French Patent Application No. 1874036 filed Dec. 21, 2018, the disclosure of which is hereby incorporated by reference in its entirety.

TECHNICAL FIELD

The present disclosure relates to the furnishing field and more particularly to a flexible member with adjustable stiffness for lying and/or sitting furniture. It is meant by "lying and/or sitting furniture" not only furniture intended for domestic use or in collective facilities, but also, for example, seats, beds, berths and/or stretchers intended for transportation means.

PRIOR ART

In order to make a sitting, backrest or lying surface adaptable to the preferences and anatomy of different users, assemblies, such as mattresses or bed bases, having flexible members with adjustable stiffness have been previously disclosed, for example, in documents EP 1 386 564 A1, EP 1 155 643 A2, WO 2008/015235, WO 96/27312, U.S. Pat. No. 4,667,357 or DE 2008 050 108 A1. Typically, the stiffness of the members is adjusted with restrictions to their mechanical deformation. For this, however, the proposed mechanisms have a significant complexity and/or space requirement.

SUMMARY OF THE INVENTION

The present disclosure aims at overcoming the aforementioned drawbacks, by proposing a flexible member with adjustable stiffness for lying and/or sitting furniture, with a simple structure and limited space requirement.

To achieve this purpose, according to a first aspect of this disclosure, the flexible member may comprise one or more inner spring(s) oriented along a central axis, one or more pair(s) of outer helical springs about the central axis, each pair of outer helical springs may comprise an upper outer helical spring and a lower outer helical spring, connected by a corresponding hinge with a pivot axis orthogonal to the central axis, and a rotating part including one or more rail(s) each extending over an arc of circle, the rotating part being able to rotate about the central axis between a blocking position, in which each rail engages the corresponding hinge of a pair of outer helical springs, so as to prevent radial displacement, relative to the central axis, of each corresponding hinge, and an unblocking position, allowing the radial displacement of each corresponding hinge.

Since, when the radial displacement of the hinges relative to the central axis is prevented, the outer helical springs will cooperate to provide a greater compressive strength than when this approximation is not prevented and since they can therefore rotate relative to each other about the corresponding hinge, the compression stiffness of the flexible member along the central axis will therefore be greater with the rotating part in the blocking position than in unblocking position. The stiffness of the flexible member can thus be adjusted by rotation of the rotating part.

The rails can be configured to enter, in the blocking position of the rotating part, into spaces defined by pairs of jaws associated with the corresponding hinges, and release them in the unblocking position of the rotating part.

The inner springs may be helical, comprise at least two springs disposed in series and/or at least two springs disposed in parallel. However, other arrangements and/or alternative forms are also conceivable.

The rotating part may in particular comprise a hub rotatably supported about the central axis by a central body secured to the inner springs, and one or more radial arm(s) connecting the hub to the rails.

A second aspect of the present disclosure relates to an assembly comprising a plurality of flexible members with adjustable stiffness such as the aforementioned flexible member, oriented in parallel. Such an assembly can therefore provide a bearing surface whose firmness will be adjustable by the stiffness of the flexible members. It is conceivable that the rotating parts of the flexible members of this assembly are coupled in rotation, so as to allow the simultaneous adjustment of the stiffness of several flexible members of the assembly.

A third aspect of the present disclosure relates to a lying or sitting furniture comprising one or more assemblies such as the above-mentioned assembly. These assemblies can be integrated, for example, in a mattress, bed base and/or cushion forming part of the furniture.

A fourth aspect of the present disclosure relates to a method for using a flexible member with adjustable stiffness such as the above-mentioned member, comprising at least one step of rotating the rotating part between the blocking and unblocking positions to adjust the stiffness of the flexible member with adjustable stiffness.

The invention will be better understood and its advantages will become more apparent upon reading the following detailed description of an embodiment represented by way of non-limiting example. The description refers to the appended drawings wherein:

BRIEF DESCRIPTION OF THE DRAWINGS

FIG. 1A is a perspective view of a flexible member according to one embodiment, with a rotating part in a first position.

FIG. 1B is a perspective view of a flexible member according to one embodiment, with a rotating part in a second position.

FIG. 2A is a side view of the flexible member of FIGS. 1A and 1B, with the rotating part in the first position.

FIG. 2B is a side view of the flexible member of FIGS. 1A and 1B, with the rotating part in the second position.

FIG. 3A is a sectional view, in a plane perpendicular to a central axis, of the flexible member of FIGS. 1A and 1B, with the rotating part in the first position.

FIG. 3B is a sectional view, in a plane perpendicular to a central axis, of the flexible member of FIGS. 1A and 1B, with the rotating part in the second position.

FIG. 4 is a detailed view of a hinge of the flexible member of the previous figures.

FIG. 5 is a perspective view of an assembly of several flexible members similar to that of the previous figures.

FIG. 6 is a schematic view of a bed incorporating assemblies similar to that of FIG. 5.

FIG. 7 is a schematic view of a sofa incorporating an assembly similar to that of FIG. 5.

DESCRIPTION OF THE EMBODIMENTS

A flexible member 10 for sitting or lying furniture such as, for example, beds, settees, bed-settees, sofas, etc., and whose compression stiffness along a central axis Z is adjustable, is illustrated in FIGS. 1A to 2B. This flexible member 10 may comprise several springs oriented along this central axis Z. Thus, the flexible member 10 may comprise one or more inner spring(s) 11. As illustrated in FIGS. 1A to 3B, these inner springs 11 may in particular be helical springs arranged in pairs, each pair of inner springs 11 comprising two springs arranged in parallel, and the pairs being arranged in series between an upper support 12 and a lower support 13 at the ends of the flexible member 10 along the central axis Z, and connected by a central body 14. However, the inner springs could possibly be different in number, differently arranged or even take an entirely different form, such as for example foam springs.

The flexible member 10 may further comprise one or more pair(s) of outer helical springs. Although, in the example illustrated in FIGS. 1A to 3B, the flexible member 10 includes two pairs of outer helical springs, a different number of pairs, less than or greater than two, is also conceivable. As illustrated, each pair of outer helical springs may comprise an upper outer helical spring 15 and a lower outer helical spring 16, respectively secured to the upper support 12 and to the lower support 13, and connected together by a corresponding hinge 17 with a pivot axis X orthogonal to the central axis Z and radially offset relative thereto. Thus, a compression of the flexible member 10 along its central axis Z can cause, through the torsion of the rods of the upper outer helical spring 15 and lower outer helical spring 16, a radial distance of each corresponding hinge 17 relative to the central axis Z.

In addition, the flexible member 10 may comprise a rotating part 20 able to rotate about the central axis Z. As illustrated in FIGS. 1A to 3B, this rotating part 20 may comprise a hub 21 engaged around the body central 14 so as to be able to rotate about the central axis Z relative to this central body 14, while restricting their relative movement in the direction of the central axis Z. In addition, the rotating part 20 may comprise one or more radial arm(s) 22 extending from the hub 21 and secured therewith, and one or more rail(s) 23*a*, 23*b* extending from each radial arm 22 and secured thereto. As in the illustrated example, these rails 23*a* and 23*b* may comprise an external rail 23*a* and an internal rail 23*b* each extending on an arc of circle about the central axis Z, the external rail 23*a* being more distant from the central axis Z than the internal axis. Moreover, the rotating part 20 may comprise connections 24 for its actuation in rotation.

As illustrated in detail in FIG. 4, each hinge 17 may comprise one or more pair(s) of jaws 18*a*, 18*b*, each pair of jaws 18*a*, 18*b* defining a space 19*a*, 19*b* able to receive one of the rails 23*a*, 23*b*. More specifically, as illustrated in FIG. 4, each hinge 17 may comprise a pair of external jaws 18*a*, defining a space 19*a* able to receive the external rail 23*a*, and a pair of internal jaws 18*b* defining a space 19*b* able to receive the internal rail 23*b*. As illustrated, both the space 19*a* defined by the external jaws 18*a* and the space 19*b* defined by the internal jaws 18*b* can be closed in the direction of the central axis Z, so that the two rails 23*a*, 23*b* thus prevent the distance of the hinge 17 relative to the central axis Z when they will be engaged in the corresponding spaces 19*a*, 19*b*.

In operation, the rotating part 20 can thus rotate between a blocking position, illustrated in FIGS. 1A, 2A and 3A, and an unblocking position, illustrated in FIGS. 1B, 2B and 3C. In the blocking position, each external 23*a* and/or internal 23*b* rail is received in a corresponding space 19*a* and/or 19*b*, so as to prevent the radial displacement of each hinge 17 relative to the central axis Z, and in particular their distance. On the other hand, in the unblocking position, the rails 23*a*, 23*b* can be recessed from the spaces 19*a*, 19*b*, so as not to prevent the radial displacement of the hinges 17, in particular in the direction opposite to the central axis Z. Accordingly, when the rotating part 20 is in its blocking position, the flexible member 10 may have a greater compression stiffness along the central axis Z than when the rotating part 20 is in its unblocking position.

Each of the components of the flexible member 10 can be made of organic polymeric material, and produced in particular by injection molding. As illustrated on FIGS. 5 to 7, a plurality of similar flexible members 10 can be combined into a single assembly 100 within a lying and/or sitting furniture such as, for example, the bed 200 of FIG. 6 or the sofa 300 of FIG. 7. In this assembly 100, the central axes Z of the flexible members 10 can be oriented in parallel, and the rotating parts 20 can be coupled in rotation, for example through the connections 24, so as to allow the simultaneous adjustment of the stiffness of several flexible members 10 of the assembly 100. The assembly 100 can be integrated in a mattress, bed base or cushion. It is also conceivable to integrate several assemblies 100, with adjustable stiffness separately, into a single mattress, bed base or cushion, so as to allow the user to adjust the stiffness in separate areas for better comfort.

Although the present invention has been described with reference to specific examples, it is obvious that various modifications and changes can be made to these examples without departing from the general scope of the invention as defined by the claims. Therefore, the description and drawings should be considered in an illustrative rather than restrictive sense.

The invention claimed is:

1. A flexible member with adjustable stiffness for lying and/or sitting furniture, comprising:

one or more inner springs oriented along a central axis, one or more pairs of outer helical springs about the central axis, each pair of outer helical springs comprising an upper outer helical spring and a lower outer helical spring, connected by a corresponding hinge with a pivot axis orthogonal to the central axis, and a rotating part including one or more rails each extending over an arc of circle, the rotating part being able to rotate about the central axis, between a blocking position, in which the rails engage the corresponding hinges of the pairs of outer helical springs, so as to prevent radial displacement, relative to the central axis, of the corresponding hinges, and an unblocking position allowing the radial displacement of each corresponding hinge.

2. The flexible member with adjustable stiffness according to claim 1, wherein the rails are configured to enter, in the blocking position of the rotating part, into spaces defined by pairs of jaws associated with the corresponding hinges, and release the jaws in the unblocking position of the rotating part.

3. The flexible member with adjustable stiffness according to claim 1, wherein the inner springs comprise at least two springs disposed in series.

4. The flexible member with adjustable stiffness according to claim 1, wherein the inner springs comprise at least two springs disposed in parallel.

5. The flexible member with adjustable stiffness according to claim 1, wherein the inner springs are helical.

6. The flexible member with adjustable stiffness according to claim 1, wherein the rotating part comprises a hub rotatably supported about the central axis by a central body secured to the inner springs, and one or more radial arms connecting the hub to the rails.

7. An assembly comprising a plurality of flexible members with adjustable stiffness according to claim 1, oriented in parallel.

8. A lying or sitting furniture comprising one or more assemblies according to claim 7.

9. A method for using the flexible member with adjustable stiffness according to claim 1, comprising at least one step of rotating the rotating part between the blocking and unblocking positions to adjust the stiffness of the flexible member with adjustable stiffness.

* * * * *